US009441569B2

(12) United States Patent
Skipp et al.

(10) Patent No.: US 9,441,569 B2
(45) Date of Patent: Sep. 13, 2016

(54) ENGINE SYSTEM AND A METHOD OF OPERATING A DIRECT INJECTION ENGINE

(71) Applicant: Ford Global Technologies, LLC, Dearborn, MI (US)

(72) Inventors: David Skipp, Brentwood (GB); Graham Hoare, Brentwood (GB); Oliver Berkemeier, Bergisch Gladbach (DE); Nicholas Dashwood Crisp, Leigh-on-Sea (GB)

(73) Assignee: Ford Global Technologies, LLC, Dearborn, MI (US)

( * ) Notice: Subject to any disclaimer, the term of this patent is extended or adjusted under 35 U.S.C. 154(b) by 448 days.

(21) Appl. No.: 13/893,150

(22) Filed: May 13, 2013

(65) Prior Publication Data

US 2013/0311062 A1 Nov. 21, 2013

(30) Foreign Application Priority Data

May 21, 2012 (GB) ..... 1208936.3

(51) Int. Cl.
*F02B 51/02* (2006.01)
*F02D 41/30* (2006.01)
(Continued)

(52) U.S. Cl.
CPC ..... *F02D 41/3005* (2013.01); *F02D 41/06* (2013.01); *F02M 53/04* (2013.01);
(Continued)

(58) Field of Classification Search
CPC ..... F02D 41/3005; F02D 41/06; F02D 41/0087; F02D 2041/389; F02D 41/40; F02M 61/166; F02M 61/1893; F02M 53/04; F02M 2200/06; F02M 2200/9038; F01N 13/011; F01N 13/107; F01N 2430/02; F02P 5/151
USPC ..... 701/102–105; 123/435, 431, 670, 123/198 A, 478, 480, 467, 538, 689, 481
See application file for complete search history.

(56) References Cited

U.S. PATENT DOCUMENTS 5,361,990 A * 11/1994 Pimentel ..... 239/133
5,755,207 A * 5/1998 Kushibe ..... 123/478
(Continued)

FOREIGN PATENT DOCUMENTS

CN 1524161 A 8/2004
CN 101400881 A 4/2009
(Continued)

OTHER PUBLICATIONS

English translation of JP H09-222030.*
(Continued)

*Primary Examiner* — Joseph Dallo
(74) *Attorney, Agent, or Firm* — Julia Voutyras; Alleman Hall McCoy Russell & Tuttle LLP

(57) ABSTRACT

Systems and methods are provided for an engine. The system comprises a direct injection engine having a cylinder in which a piston is slidingly supported to form in combination with a cylinder head a combustion chamber; a fuel injector for the cylinder having a catalytic coated tip portion that projects into the combustion chamber; and an electronic controller to control the operation of the engine and operates the engine in a heating mode of operation if heating of the fuel injector tip is requested. Various methods for heating the fuel injector tip are proposed including operating the engine on a reduced number of cylinders and varying one or both of fuel injection timing and quantity of fuel injected and the ignition timing in order to increase the temperature of combustion.

20 Claims, 5 Drawing Sheets

(51) Int. Cl.

| | |
|---|---|
| ***F02D 41/06*** | (2006.01) |
| ***F02M 53/04*** | (2006.01) |
| ***F02M 61/18*** | (2006.01) |
| ***F02M 61/16*** | (2006.01) |
| *F02D 41/00* | (2006.01) |
| *F02D 41/40* | (2006.01) |
| *F02P 5/15* | (2006.01) |
| *F02D 41/38* | (2006.01) |
| *F01N 13/10* | (2010.01) |
| *F01N 13/00* | (2010.01) |

(52) U.S. Cl.

CPC ..... *F02M 61/166* (2013.01); *F02M 61/1893* (2013.01); *F01N 13/011* (2014.06); *F01N 13/107* (2013.01); *F01N 2430/02* (2013.01); *F02D 41/0087* (2013.01); *F02D 41/40* (2013.01); *F02D 2041/389* (2013.01); *F02M 2200/06* (2013.01); *F02M 2200/9038* (2013.01); *F02P 5/151* (2013.01)

(56) References Cited

U.S. PATENT DOCUMENTS

| | | | | |
|---|---|---|---|---|
| 5,860,394 | A * | 1/1999 | Saito et al. | 123/41.31 |
| 6,178,944 | B1 * | 1/2001 | Kerns et al. | 123/295 |
| 6,267,307 | B1 * | 7/2001 | Pontoppidan | 239/585.4 |
| 6,276,340 | B1 | 8/2001 | Kato | |
| 6,295,969 | B1 * | 10/2001 | Kato et al. | 123/470 |
| 6,718,944 | B2 | 4/2004 | Franke et al. | |
| 6,832,593 | B2 * | 12/2004 | Imoehl | 123/294 |
| 6,892,691 | B1 * | 5/2005 | Uhl et al. | 123/198 A |
| 6,978,204 | B2 * | 12/2005 | Surnilla et al. | 701/103 |
| 6,988,490 | B2 * | 1/2006 | Satou | 123/480 |
| 8,245,951 | B2 * | 8/2012 | Fink et al. | 239/5 |
| 2002/0050536 | A1 * | 5/2002 | Imoehl | 239/533.12 |
| 2002/0179040 | A1 * | 12/2002 | Dalla Betta | 123/298 |
| 2003/0084713 | A1 * | 5/2003 | Imoehl | 73/119 A |
| 2004/0050359 | A1 * | 3/2004 | Imoehl | 123/295 |
| 2004/0069284 | A1 * | 4/2004 | Corba | 123/563 |
| 2004/0103876 | A1 * | 6/2004 | Spiegel et al. | 123/305 |
| 2004/0112327 | A1 * | 6/2004 | Spiegel et al. | 123/294 |
| 2004/0149273 | A1 * | 8/2004 | Suck et al. | 123/670 |
| 2004/0260449 | A1 * | 12/2004 | Heinstein et al. | 701/101 |
| 2005/0178360 | A1 * | 8/2005 | Satou | 123/431 |
| 2005/0189683 | A1 * | 9/2005 | Yeckley | 264/659 |
| 2006/0201472 | A1 * | 9/2006 | Kerns et al. | 123/198 A |
| 2007/0000480 | A1 * | 1/2007 | Hoenig et al. | 123/470 |
| 2007/0051092 | A1 * | 3/2007 | Pallett et al. | 60/276 |
| 2007/0215102 | A1 * | 9/2007 | Russell et al. | 123/310 |
| 2007/0227492 | A1 * | 10/2007 | Cheiky | 123/304 |
| 2007/0227493 | A1 * | 10/2007 | Cheiky | 123/304 |
| 2007/0227494 | A1 * | 10/2007 | Cheiky | 123/304 |
| 2008/0201057 | A1 * | 8/2008 | Aliakbarzadeh et al. | 701/103 |
| 2008/0271712 | A1 * | 11/2008 | Abi-Akar et al. | 123/468 |
| 2009/0000595 | A1 * | 1/2009 | Ashizawa et al. | 123/435 |
| 2009/0000605 | A1 * | 1/2009 | Craig et al. | 123/549 |
| 2009/0078227 | A1 * | 3/2009 | Aradi et al. | 123/1 A |
| 2009/0090332 | A1 * | 4/2009 | Brehob | 123/464 |
| 2009/0099753 | A1 * | 4/2009 | Kaneko | 701/103 |
| 2010/0049421 | A1 * | 2/2010 | Futonagane et al. | 701/103 |
| 2010/0070158 | A1 * | 3/2010 | Futonagane et al. | 701/105 |
| 2010/0094527 | A1 * | 4/2010 | Futonagane et al. | 701/103 |
| 2010/0229534 | A1 * | 9/2010 | Matsunaga | 60/274 |
| 2012/0316760 | A1 * | 12/2012 | Grieser et al. | 701/108 |

FOREIGN PATENT DOCUMENTS

| | | | | |
|---|---|---|---|---|
| DE | 10361976 | A1 * | 6/2005 | F01L 3/08 |
| JP | S5941662 | A | 3/1984 | |
| JP | 09222030 | A * | 8/1997 | |
| WO | WO 0050763 | A1 * | 8/2000 | |
| WO | 02055851 | A1 | 7/2002 | |
| WO | 03002859 | A1 | 1/2003 | |
| WO | WO 2007105080 | A2 * | 9/2007 | F02D 35/02 |

OTHER PUBLICATIONS

Partial Translation of Office Action of Chinese Application No. 2013101832208, Issued Jul. 6, 2016, State Intellectual Property Office of PRC, 8 Pages.

* cited by examiner

ENGINE SYSTEM AND A METHOD OF OPERATING A DIRECT INJECTION ENGINE

CROSS REFERENCE TO RELATED APPLICATIONS

The present application claims priority to United Kingdom Patent Application No. 1208936.3, filed on May 21, 2012, the entire contents of which are hereby incorporated by reference for all purposes.

TECHNICAL FIELD

This invention relates to direct injection engines and in particular to the operation of such an engine in a manner to minimize particulate emissions from the engine.

BACKGROUND AND SUMMARY

Various government and international regulations are in force or are being investigated to minimize particulate generation. For gasoline direct injection (GDI) it is particularly important to obtain a very precise spray pattern in order to minimize particulate production.

One problem with direct injection and GDI in particular is that deposits build up on a tip portion of each fuel injector due to its exposure to the combustion process.

In order to obtain the precise spray patterns required the fuel injectors have to be produced with very detailed structures such as sharp edges and these are affected by the build-up of coke deposits on the tip portion of the fuel injector resulting in increased soot production. The coke deposits are generally of a carbon based nature and are produced as by-products of the combustion process.

In addition, because the coke deposits are porous in nature, fuel can soak into the coke deposit and is then burnt late in the combustion process resulting in the production of soot.

In order to reduce or eliminate such coking it is known from, for example, Japanese Patent Publication JP-A-59041662 to provide a catalytic coating on the injector tip portion of a fuel injector to promote the reduction in the build-up and/or removal of the coke deposits.

The applicants have found that under normal working conditions when the engine is under load such a catalytic coating is effective in reducing coke build-up and in facilitating the removal of such deposits during operation of the engine.

It is however a problem that the catalytic material is not very effective at light loads or in repetitive stop start conditions where coking can form due to the relatively low temperature of the tip portion of the fuel injector in such conditions.

The above problem is solved according to a first aspect of the invention there by providing an engine system that comprises a direct injection engine having a cylinder in which a piston is slidingly supported to form in combination with a cylinder head a combustion chamber, a fuel injector for the cylinder having a catalytic coated tip portion that projects into the combustion chamber and an electronic controller to control the operation of the engine and operates the engine in a heating mode of operation if heating of the fuel injector tip is requested.

If heating of the injector tip portion is not requested, the electronic controller may be operable to operate the engine in a normal mode of operation.

Heating of the fuel injector tip may be required if the temperature of the catalytic coated tip portion is below a light-off temperature of the catalytic material.

Heating of the fuel injector tip may be required if the temperature of the catalytic coated tip portion is below a light-off temperature of the catalytic material and de-coking of the injector tip is required.

Operating the engine in the heating mode may comprise increasing the temperature of combustion by using the electronic controller to adjust at least one of the timing the injection of fuel and the quantity of fuel injected into the combustion chamber.

The engine may be a multi-cylinder engine. In which case, operating the engine in the heating mode comprises using the electronic controller to disable at least one of the cylinders of the engine so as to increase the loading on each cylinder still operating.

The cylinders of the engine may be disabled in a predetermined sequential order.

Each disabled cylinder may be arranged to pump air while it is disabled.

Operating the engine in the heating mode may comprise operating at least one cylinder rich of stoichiometric and at least one cylinder lean of stoichiometric so as to promote an increased combustion temperature and an oxidizing environment in the at least one lean operated cylinder.

Operating the engine in the heating mode may comprise operating at least one cylinder lean of stoichiometric and at least one cylinder leaner than the at least one lean of stoichiometric operating cylinder so as to promote an increased combustion temperature in the at least one leaner operated cylinder.

The engine may be a spark ignited engine and operating the engine in the heating mode may comprise increasing the temperature of combustion by using the electronic controller to adjust the timing of the ignition to one of retarded and advanced relative to a normal timing position.

According to another aspect of the invention there is provided a method of operating a direct injection combustion engine, each cylinder of the engine having a fuel injector with a catalytic coated tip portion that is exposed to the products of combustion; comprising operating the engine in a heating mode of operation in response to a request to heat the fuel injector tip.

If heating of the fuel injector tip portion is not requested, the method may comprise operating the engine in a normal mode of operation.

Heating of the fuel injector tip may be requested if the temperature of the catalytic coated tip portion is below a light-off temperature of the catalytic material.

Heating of the fuel injector tip may be requested if the temperature of the catalytic coated tip portion is below a light-off temperature of the catalytic material and de-coking of the injector tip is required.

Operating the engine in the heating mode may comprise adjusting at least one of the timing the injection of fuel and the quantity of fuel injected into each operating cylinder.

The engine may be a multi-cylinder engine. In which case, operating the engine in the heating mode may comprise disabling at least one of the cylinders of the engine so as to increase the loading on the cylinders still operating.

The cylinders of the engine may be disabled in a predetermined sequential order.

Each disabled cylinder may be arranged to pump air while it is disabled.

Operating the engine in the heating mode may comprise operating at least one cylinder rich of stoichiometric and at least one cylinder lean of stoichiometric so as to promote an increased combustion temperature and an oxidizing environment in the at least one lean operated cylinder.

Operating the engine in the heating mode may comprise operating at least one cylinder lean of stoichiometric and at least one cylinder leaner than the at least one lean of stoichiometric operating cylinder so as to promote an increased combustion temperature in the at least one leaner operated cylinder.

The engine may be a spark ignited engine and operating the engine in the heating mode may comprise adjusting the timing of the ignition to one of retarded and advanced relative to a normal timing position for each operating cylinder.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Further, the inventors herein have recognized the disadvantages noted herein, and do not admit them as known.

DETAILED DESCRIPTION OF THE DRAWINGS

Figure 1:
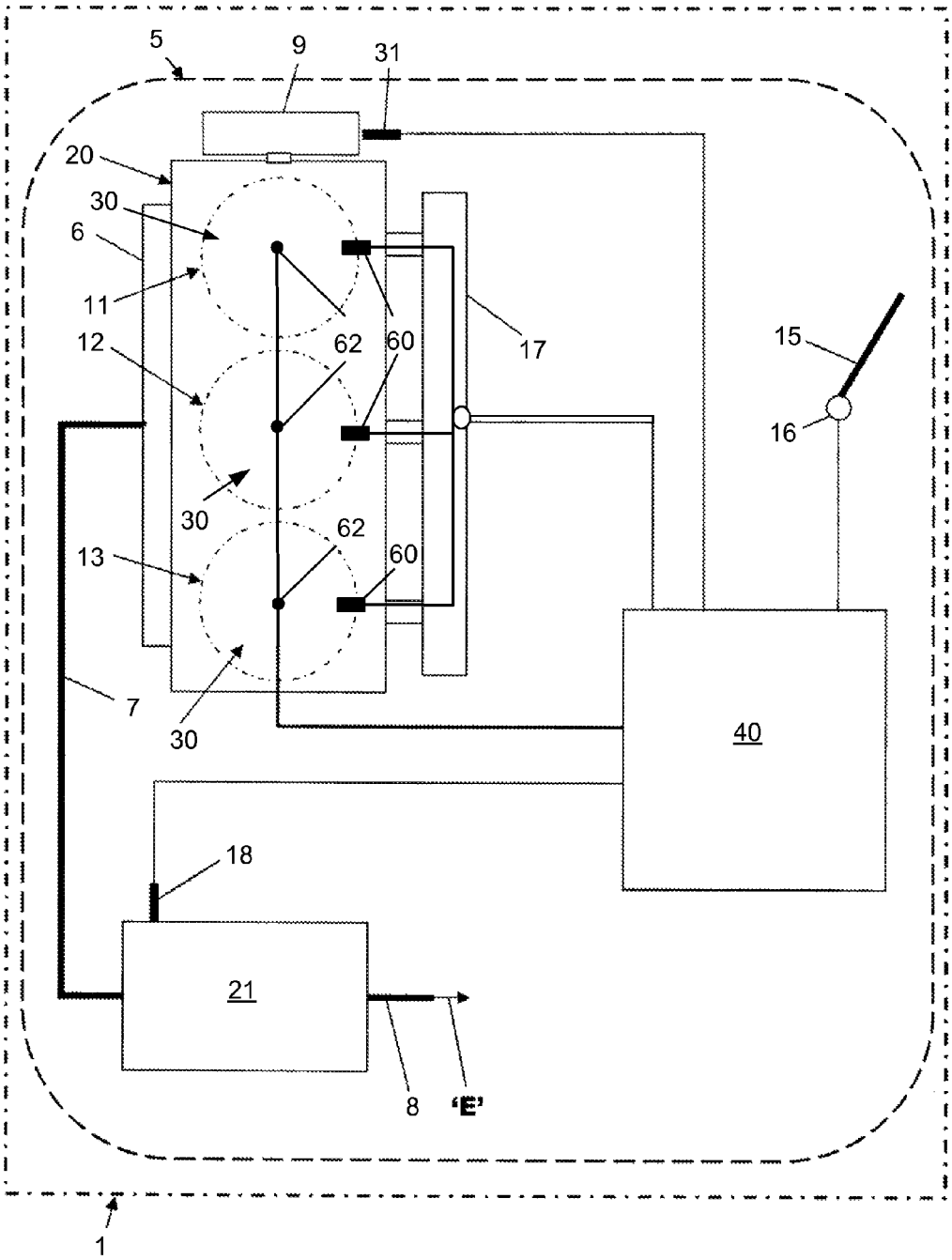
FIG. 1 is a block diagram showing an engine system according to a first aspect of the invention.
Figure 2A:
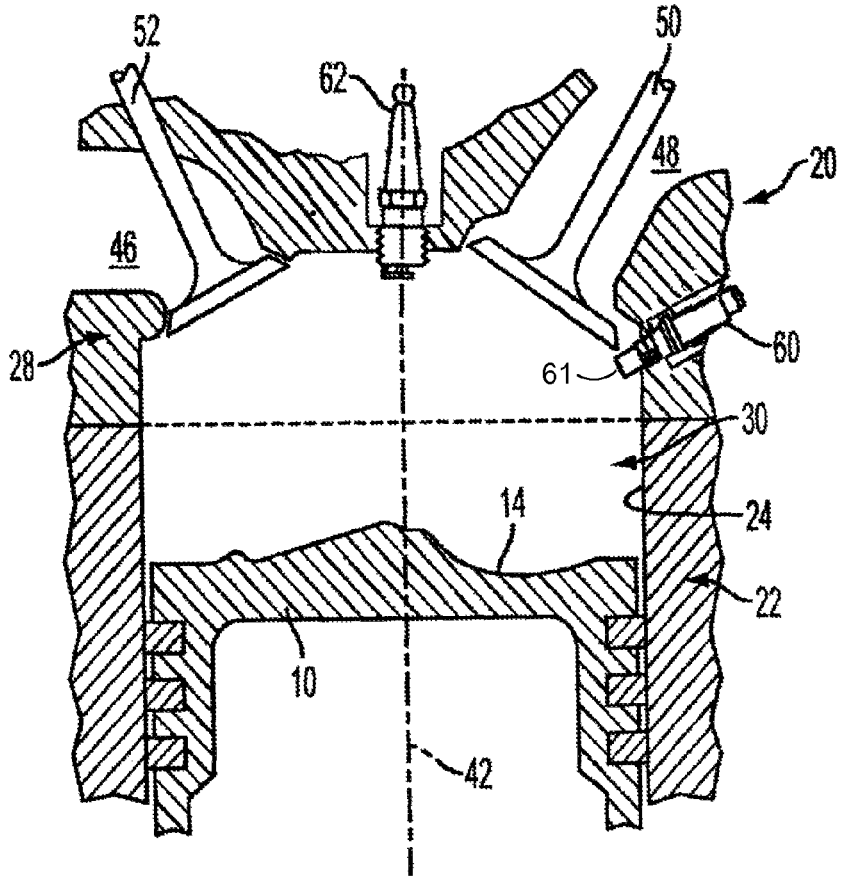
FIG. 2A is a schematic cross-section through one cylinder of a direct injection inline three cylinder engine forming part of the engine system according to the first aspect of the invention.
Figure 2B:
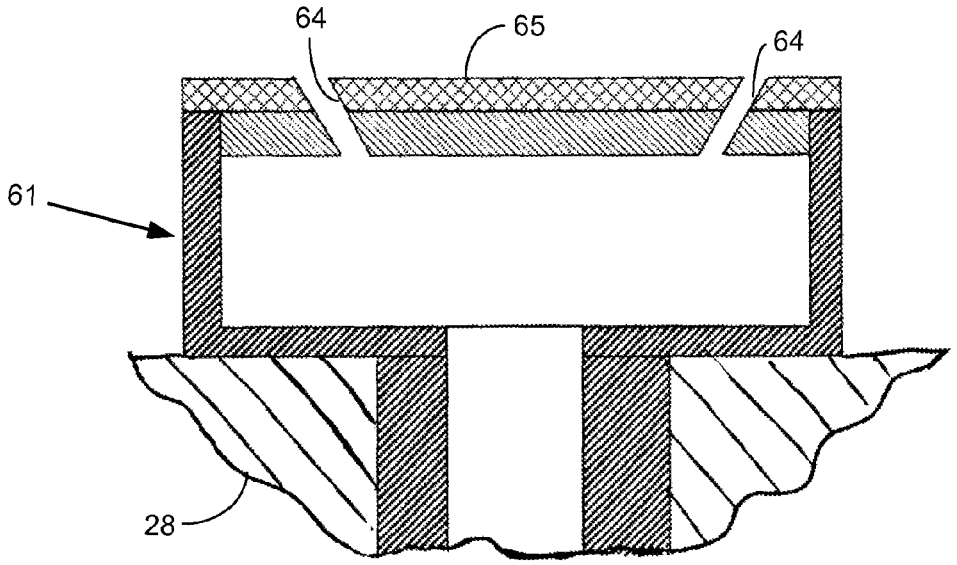
FIG. 2B is an enlarged cross-section through a tip portion of a fuel injector used in the engine shown in FIG. 2.

With particular reference to FIGS. 1, 2A and 2B there is shown a motor vehicle 1 having an engine system 5 comprising a direct injection three cylinder reciprocating piston internal combustion engine 20, an exhaust aftertreatment device 21 for the engine 20, an electronic controller 40, an operator demand input device in the form of an accelerator pedal 15 and an associated accelerator pedal position sensor 16.

It will be appreciated that the electronic controller 40 may comprise several interlinked electronic controllers, control units or electronic processors such as an ignition controller, a fuel injection controller and a powertrain controller and is shown as a single unit for the purpose of illustration only.

The engine system 5 also includes an exhaust gas temperature sensor 18 to provide an output indicative of the temperature of the exhaust gas entering the aftertreatment device 21 and an engine speed sensor 31 associated with a toothed ring on a flywheel 9 of the engine 20.

It will be appreciated that other means for measuring engine speed could be used and that the invention is not limited to the use of a toothed ring and engine speed sensor. It will further be appreciated that the exhaust temperature could be modeled and need not be measured.

The engine 20 comprises in this case of three cylinders 11, 12 and 13 arranged inline, therebeing two outer cylinders 11, 13 and a centre cylinder 12 interposed between the two outer cylinders 11, 13.

An exhaust manifold 6 directs exhaust gas leaving the engine 20 through an exhaust conduit 7 to the aftertreatment device 21 and a tailpipe 8 conducts exhaust gas from the aftertreatment device 21 to atmosphere as indicated by the arrow 'E'. It will be appreciated that the aftertreatment device 20 can be of any known type suitable for reducing the emissions from the engine 20 and that there may be more than one type of exhaust aftertreatment device connected to the exhaust conduit 7. It will also be appreciated that one or more devices to reduce exhaust noise may be fitted into the tailpipe 8 downstream from the aftertreatment device or devices 21.

An intake manifold 17 directs air from the atmosphere into the engine 20. In some cases the air entering the intake manifold 17 may be of increased pressure if a turbocharger or other form of air intake booster is fitted to the engine 20.

The position of the accelerator pedal 15 is sensed by the accelerator pedal position sensor 16 and the output from the sensor 16 is supplied as an input to the electronic controller 40 where it is processed to provide an indication of operator engine torque demand.

The output from the engine speed sensor 41 is used by the electronic controller 40 as an indication of current engine speed.

FIG. 2A is a cross-section of one of the cylinders 11 or 12 or 13 of the engine 20 illustrating in more detail the construction of the engine 20.

The engine 20 includes an engine block 22 having in this case three of cylinder bores 24 defining the cylinders 11, 12, 13. Each cylinder 11, 12, 13 has a respective combustion chamber 30 and each combustion chamber 30 is defined by a cylinder head 28 of the engine 20, the respective cylinder bore 24, and a respective piston 10.

Each piston 10 is slidingly supported by a respective cylinder bore 24 along a longitudinal axis 42 of the respective cylinder 11, 12 and 13. Each piston 10 is disposed for reciprocating movement within its respective cylinder bore 24 and is coupled in a conventional manner to a crankshaft (not shown) by a connecting rod (not shown). Each piston 10 includes a domed top having a combustion bowl 14 formed therein to produce a desired air-fuel mixture cloud formation.

The cylinder head 28 includes various exhaust ports 46 and intake ports 48 to admit and discharge gas from the three cylinders 11, 12 and 13. In the disclosed embodiment each cylinder 11, 12 and 13 includes two intake ports 48 and two exhaust ports 46 (only one of each being shown in FIG. 2A). It will be appreciated by those of ordinary skill in the art that alternative configurations could have a different number of intake ports and exhaust ports.

Each combustion chamber 30 includes an intake valve 50 for each intake port 48 and an exhaust valve 52 for each exhaust port 46. Each intake valve 50 selectively couples the respective combustion chamber 30 to the associated intake manifold 17 (not shown on FIG. 2A). Similarly, each exhaust valve 52 selectively couples the respective combustion chamber 30 to the associated exhaust manifold 6 (not shown on FIG. 2A).

It will be appreciated that, the intake manifold 17 and/or the exhaust manifold 6 may be integrally formed with the cylinder head 28 or may be separate components depending upon the particular application.

The intake valves 50 and exhaust valves 52 of the engine 20 may be operated using any of a number of known strategies including a conventional camshaft arrangement, variable camshaft timing and/or variable lift arrangements, or using electromagnetic valve actuators, for example.

Each combustion chamber 30 also includes an ignition source which in this case is in the form of a respective spark plug 62 that extends through a roof of the respective cylinder 11, 12 and 13.

Each combustion chamber 30 further includes an associated fuel injector 60 mounted in cylinder head 28. Each fuel injector 60 has a tip portion 61 that is located within the respective combustion chamber 30 and which in use is exposed to the products of combustion. In the case of a side mounted fuel injector 60 as shown, a longitudinal axis of each fuel injector 60 is disposed at an angle relative to the cylinder longitudinal axis 42 of the respective cylinder 11, 12 and 13 and this angle will depend upon the particular application and implementation. It will be appreciated that the fuel injector 60 need not be side mounted and could be top mounted so as to spray downwardly rather than side mounted and that the invention is not limited to any particular fuel injector position or orientation.

Each tip portion 61 includes at least one aperture, hole or jet through which in use fuel is injected into the respective combustion chamber 30. In this case, each tip portion 61 has eight apertures 64 which when activated produce eight cone shaped sprays of fuel into the respective combustion chamber 30. It will be appreciated that the invention is not limited to use with a multi-hole injector configuration and that other injector configurations such as, for example, an outwardly opening valve configuration such as the injector shown in published European Patent Application EP-A-1854995 would also benefit by the use of this invention.

Each tip portion 61 has a catalytic coating 65 applied to it to minimize the build-up of carbon based deposits often referred to as coke on the tip portion 61. In this case the catalytic coating 65 is applied only to an end face of the tip portion 61 but in other embodiments other coating arrangement could be used.

During operation, in response to one or more corresponding fuel injection signal(s) generated by the engine controller 40, each fuel injector 60 sprays fuel substantially simultaneously through its eight apertures 64 directly into the respective combustion chamber 30 to create a desired fuel spray pattern.

Therefore the engine system 5 comprises in this case a three cylinder direct injection engine 20 having three cylinders 11, 12 and 13 in each of which a respective piston 10 is slidingly supported to form in combination with the cylinder head 28 a combustion chamber 30. Each cylinder 11, 12, 13 has a respective fuel injector 60 having a catalytic coated tip portion 61 that extends through the cylinder wall 22 of the respective cylinder 11, 12 and 13 so as to project into the combustion chamber 30.

The electronic controller 40 is arranged to control the operation of the engine 20 and can operate the engine 20 in at least a normal mode of operation and a heating mode of operation.

In the normal mode of operation the engine 20 is operated so as to satisfy torque demands made by an operator as indicated by the position of the throttle pedal 15. When operated in the normal mode of operation the timing and quantity of fuel injected are those required to meet the requested torque demand in an efficient manner without producing high levels of exhaust emissions. Similarly, the ignition timing is set to a normal position so as to produce efficient combustion within the respective combustion chambers 30 of the engine 20.

When the engine 20 is operating in low load conditions such as idling in traffic or the vehicle 1 is moving at low speed requiring very little torque output or is subject to repetitive and frequent stopping and starting, the temperature of the fuel injector tip portions 61 of the respective fuel injectors 60 will tend to fall to a temperature similar to that of the surrounding material of the engine 20 which is typically in the region of 100° C. Because the catalytic material with which the injector tip portion 61 is coated operates effectively only above a light-off temperature, which in this case is 200° C., operating below this light-off temperature will produce little or no beneficial catalytic effect thereby allowing coking to occur. It will be appreciated that the actual light-off temperature will depend upon the composition of the catalytic material and that 200° C. is provided by way of example only.

The electronic controller 40 is therefore operable to determine whether heating of the fuel injector tip 61 is required and, if heating is required, operate the engine 20 in the heating mode of operation.

The electronic controller 40 can determine whether heating is required by using a direct measurement of temperature and comparing the measured temperature with a low temperature limiting value such as, for example, 200° C. In this case a temperature sensor would need to be located on each of the fuel injectors 60 and the output from the respective temperature sensors would be received by the electronic controller 40 and compared with the low temperature limit as discussed above. It will be appreciated that the temperature of the tip portions 61 need not be actually measured it would be possible to measure the temperature close to the tip portions 61 and then use experimentally produced conversions which could be stored in a look-up table in the electronic controller 40 or could be in the form of an executable equation to convert from measured temperature to tip portion temperature.

As a further option the temperature could be modeled based upon various engine sensors such as engine coolant temperature, cylinder head temperature, engine speed, engine load or ignition timing which could provide estimates for combustion temperature and/or exhaust temperature from which it could be deduced when heating of the tip portions is required.

As an alternative to direct temperature measurement or modeled temperature the temperature of the tip portions 61 could be inferred from the duty cycle of the engine 20. That is to say, the speed of the engine 20 and the torque demand from the throttle pedal or other combustion variables such as air charge, spark timing, intake air temperature and cam timing could be used to determine when the engine operating conditions are such that heating of the injector tips 61 is likely to be required in order for the catalytic material to operate effectively.

In addition to the above, the scheduling of the heating mode may be based not solely on the temperature of the tip portions 61 but also upon a model of accretion. That is to say, it may be the case that the heating mode is not used every time the temperature of the tip portions 61 is measured or estimated to be below the light-off temperature it may be that the heating mode is only employed when the temperature of the tip portions 61 is measured or estimated to be below the light-off temperature and the coke build up predicted from an accretion model is estimated to be likely to significantly and adversely affect the fuel spray pattern.

Whenever heating of the injector tip portions 61 is not required, the electronic controller 40 is operable to operate the engine 20 in the normal mode of operation discussed above.

Several methods can be used to increase the temperature of the tip portions 61.

In a first approach, operating the engine in the heating mode comprises increasing the temperature of combustion by using the electronic controller 40 to adjust the timing of the ignition to one of retarded and advanced relative to the normal timing position. The first approach is therefore based on spark adjustment away from optimal timing for best torque. This adjustment affects mass flow of air and fuel through the engine 20 and gas temperatures during the combustion process.

Using spark retard increases mass flow and can increase total energy expended in the combustion chamber, however spark retard will tend to lower peak temperature and peak pressure. Extreme levels of spark retard can be facilitated by injecting some portion of the fuel synchronized with the spark ignition event to create stable ignition.

Using spark advance that is to say, an ignition timing that is more advanced than the timing for best torque, will increase mass flow and increase combustion temperature and pressure. Thus spark advance is more likely to promote rapid heat rise at the injector tip portions 61 as more of the waste energy is expended within the combustion chamber whereas with spark retard the excess energy tends to be expelled from the combustion chamber 30 and will increase the temperature of the exhaust gasses flowing to the aftertreatment device(s) 21. Therefore spark retard may be useful if the engine 20 is started from cold and spark advance might be more beneficial if the engine 20 has been operating for some time and the aftertreatment device(s) 21 are operating efficiently.

If large levels of spark advance are used then combustion stability and feed-gas emissions may be improved by adjusting some portion of the fuel injection event in harmony with the spark event.

Operating the engine in the heating mode could also comprise increasing the temperature of combustion by using the electronic controller 40 to adjust at least one of the timing the injection of fuel and the quantity of fuel injected into each combustion chamber 30.

For example, by operating one cylinder lean while others are operated rich to compensate. This would keep stoichiometric operation in the exhaust (good for aftertreatment) but increase the temperature in the cylinder in which decoking is occurring. It will be appreciated that running a cylinder slightly lean will increase the combustion temperature in that cylinder and create an oxidizing environment. In the case of a single cylinder engine, the cylinder could be modulated between lean and rich such that the mean exhaust over time is stoichiometric. This would keep stoichiometric operation in the exhaust (good for aftertreatment) but increase the temperature in the cylinder in which decoking is occurring. Such a technique would however require torque compensation to avoid surge. Torque compensation could be achieved on a spark ignited engine via spark timing adjustment.

In a second approach which is applicable only to engine having more than one cylinder such as multi-cylinder engines, heating of the fuel injector tip portions 61 can be achieved by selectively disabling one of more cylinders of the engine 20. Therefore in this case operating the engine 20 in the heating mode comprises using the electronic controller 40 to disable at least one of the cylinders 11, 12 and 13 of the engine 20 so as to increase the loading on each cylinder 11, 12 and 13 still operating.

The cylinders 11, 12 and 13 of the engine 20 are disabled in a predetermined sequential order which depend upon the firing order of the cylinders 11, 12, 13 so as to minimize torque fluctuations. It will be appreciated that in engines having more than two cylinders more than one cylinder could be disabled at the same time so as to further increase the load on the cylinders remaining in operation.

In the case of the three cylinder engine 20 provided herein by way of example the cylinders 11, 12, 13 are disabled one at a time in the order 11, 12, 13; 11, 12, 13 etc. The cylinder disabled may remain disabled for a predetermined number of cycles of the engine 20 or may remain disabled until the catalytic coatings 65 on the respective fuel injector tip portions 61 of the operating cylinders have been sufficiently heated to activate them.

It will be appreciated that when a disabled cylinder 11, 12, 13 is re-activated the rapid heating will have a beneficial effect in loosening or removing any coke deposits that have accumulated on the respective fuel injector tip portions 61. The cooling associated with a deactivation event may also have a positive effect on loosening coke deposits.

Preferably each disabled cylinder 11, 12, 13 is arranged to pump air while it is disabled which can be achieved by simply not supplying fuel to the respective disabled cylinder 11, 12, 13.

It will be appreciated that the use of ignition adjustment could also be applied to the non-disabled cylinders 11, 12, 13. So that for example the cylinders still operating could be operated using an advanced or a retarded ignition timing setting.

Figure 3:
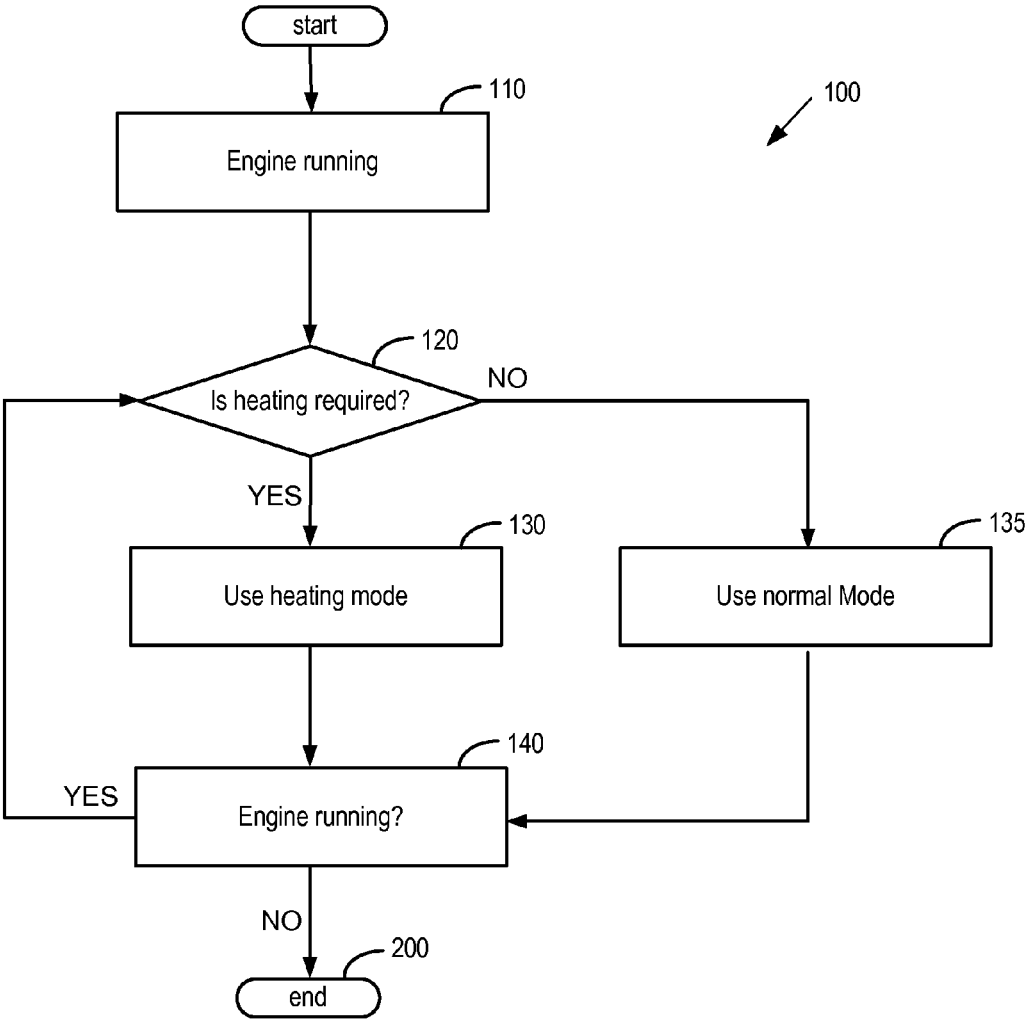
FIG. 3 is a high level flow chart of a method of operating a direct injection engine in accordance with a second aspect of the invention.

Referring now in particular to FIG. 3 there is shown a method 100 used by the electronic controller 40 to control the operation of the engine 20.

The method 100 starts and proceeds to step 110 which is an engine running event for the vehicle 1. That is to say, the method starts when the engine 20 is running.

The method 100 then advances to step 120 where it is determined whether heating of the fuel injector tips 61 is required. As discussed above this can be based upon temperature measurement or modeling or can be deduced from the duty cycle of the engine 20.

If it is determined that heating is not required then the method 100 advances to step 135 where a normal mode of engine operation is used to control the operation of the engine 20. That is to say, the ignition timing and fuelling are those required to meet the requested torque demand in an efficient and low emission manner.

The method then advances from step 135 to step 140 where it is determined whether the engine 20 is still running. If the engine 20 is not running then the method ends at step 200 but otherwise it returns to step 120 to recheck whether heating is required.

Returning to step 120 if heating is required then the method 100 advances to step 130 where the electronic controller 40 operates the engine 20 in a heating mode of operation. In the heating mode of operation as discussed above various techniques are employed to increase the temperature of the fuel injector tip portions 61 from their current temperature to a temperature where the catalytic coating 65 applied to each of the fuel injector tip portions 61 is activated to assist with the removal of coke from the fuel injector tip portions 61.

As referred to previously, the scheduling of the heating mode may be based not solely on the temperature of the tip portions 61 but also upon a model of accretion. In such a case the method step 120 would be replaced by a step in which a combination of temperature and a predefined level of accretion from an accretion model would need to be present for the heating mode to be entered.

For example the step 120 could take the form:—If $T_{tip}<T_{light\text{-}off}$ AND $A>A_{limit}$ then enter heating mode; ELSE use normal mode.

Where:—$T_{rip}$=measure or estimate injector tip temperature; $T_{light\text{-}off}$=Light-off temperature of catalytic material; A=estimated accretion from accretion model; and $A_{limit}$=Accretion level above which a significant adverse effect on spray pattern can be expected.

As yet further alternatives the step 120 could be replaced by a combination of injector tip temperature and time since the last decoking event took place or the time could be a variable time limit based upon a predicted level of coke build up from an accretion model.

As discussed above, the heating mode can use ignition timings that are advanced or retarded from the ignition timing that would be used in the normal mode of operation and can include adjusting the timing of the fuel injected and/or the quantity of fuel injected.

Alternatively or in combination with such approaches the electronic controller 40 can, in the case of a multi-cylinder engine, operate the engine 20 in the heating mode by disabling at least one of the cylinders 11, 12, 13 of the engine 20 so as to increase the loading on the cylinders 11, 12, 13 still operating. As referred to above the cylinders 11, 12, 13 of the engine 20 are disabled in a predetermined sequential order and each of the cylinders 11, 12, 13 not disabled is operated lean of stoichiometric so as to produce an oxidizing environment within the respective cylinder 11, 12, 13. Preferably, each disabled cylinder 11, 12,13 is arranged to pump air while it is disabled.

Fuel injection to a predetermined number of cylinders may disabled to increase loading of the remaining cylinders and said predetermined number of cylinders may be coupled through an exhaust manifold to a first catalytic converter and said remaining cylinders are coupled to another exhaust manifold to a second catalytic converter. In a V-6 engine a predetermined number of cylinders may comprise one bank of a V-6 engine and said remaining cylinders comprise another bank of said V-6 engine. In an I-4 engine said predetermined number of cylinders may comprise the two outer cylinders of an I-4 engine and said remaining cylinders may comprise the two inner cylinders of said I-4 engine.

The fuel injectors of the disabled cylinder my likewise be disabled while the intake and exhaust valves remain operable. In this way, air is pumped in through the intake valve and out through the exhaust valve for those cylinders that are disabled by disabling the appropriate fuel injectors. Further steps are then taken to prevent this pumped air from entering a catalytic converter which is coupled to the cylinders that are not disabled. Such coupling of air would cause an overall lean exhaust environment where the excess air may prevent the catalytic converter from reducing nitrogen oxides (NOx). The excess air may also result in storage of the excess oxygen in the catalytic converter which may impair its ability to reduce nitrogen oxides. This is often referred to as poisoning the catalyst. These potential problems may be overcome by coupling the cylinders that will be disabled to one catalytic converter and coupling the other cylinders that are not disabled to another catalytic converter. Examples of such separation of the catalytic converters are described below in reference to FIGS. 4 and 5.

The method then advances from step 130 to step 140 where it is determined whether the engine 20 is still running. If the engine 20 is not running then the method ends at step 200 but otherwise it returns to step 120 to recheck whether heating is required.

Although the invention has been described by way of example with reference to a three cylinder gasoline direct injection engine it will be appreciated that it is not limited to use on such an engine and could be applied to engines having a differing number of cylinders. Non-limiting examples of different engines are shown in FIGS. 4 and 5.

Figure 4:
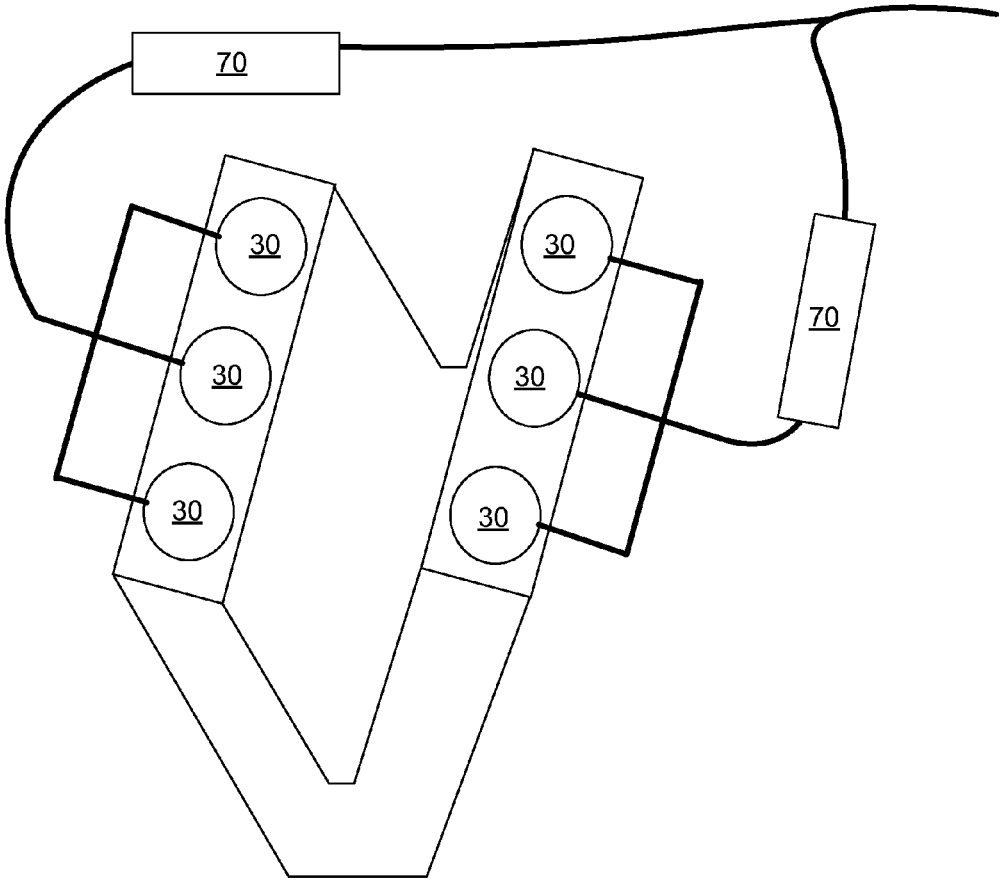
FIG. 4 is a block diagram of a V-6 engine configuration which uses the invention to advantage.

In reference to FIG. 4 a V-6 engine is shown, wherein each bank of 3 combustion chambers 30 are shown with an exhaust manifold and piping leading into their own catalytic converter 70. In this way one bank of the engine may be disabled at a time by cutting off that bank's fuel injectors.

Figure 5:
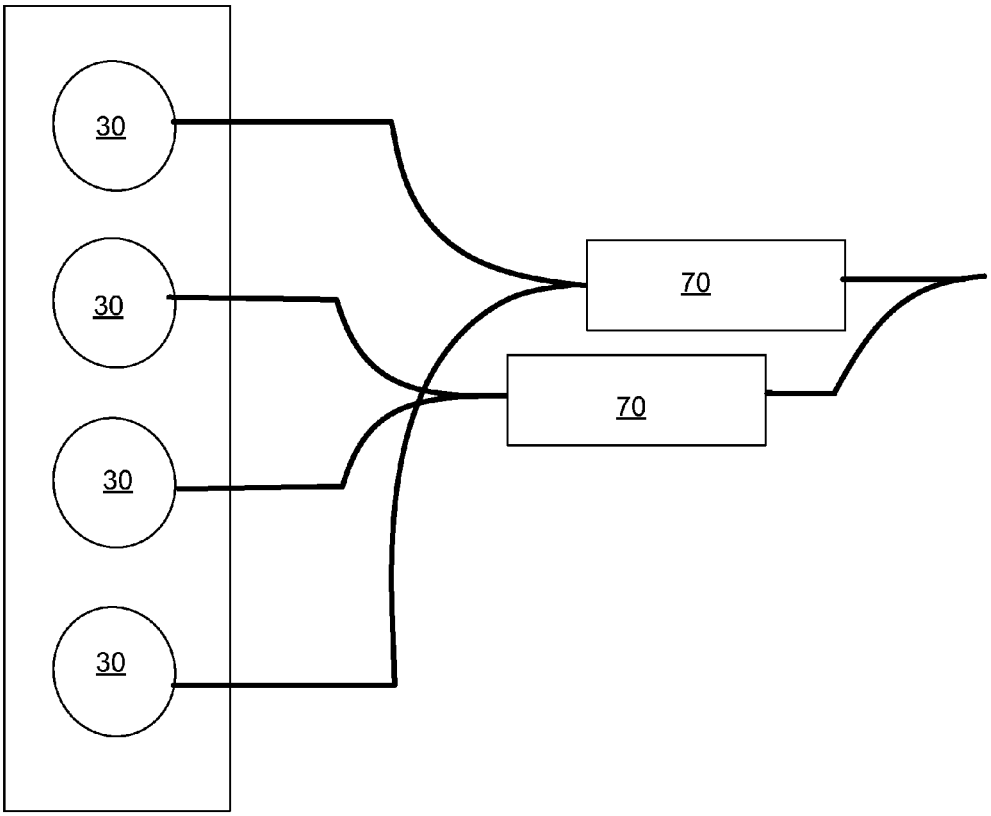
FIG. 5 is a block diagram of an I4 engine configuration which uses the invention to advantage.

Shown in FIG. 5 is an I-4 engine where the exhaust gases of the two outside cylinders 30 have an exhaust manifold and piping leading into a catalytic converter 70 and the two inside cylinders likewise share an exhaust manifold and piping leading into a separate catalytic converter 70. In this way one group, either the inside or outside cylinders, may be disabled at a time by cutting off that groups fuel injectors.

This separation of cylinder groups into distinct catalytic converters as shown in FIGS. 4 and 5 allows cylinders to be disabled without leaning an exhaust flow through a catalytic converter altering the ability to reduce $NO_x$ as described above.

It could also be applied to direct injection engine utilizing other types of fuel.

In the case of a direct injection compression ignition (diesel) engine it will be appreciated that injection timing can be used to increase the temperature of combustion rather than varying the spark timing. In a diesel engine operation slightly lean of stoichiometric is normal and so in this case heating can be enhanced by operating at least one cylinder normally that is to say, lean of stoichiometric and operating at least one cylinder of the engine leaner than the at least one lean of stoichiometric operating cylinder so as to promote an increased combustion temperature in the at least one leaner operated cylinder.

Systems and methods are provided for an engine. The system comprises a direct injection engine having a cylinder in which a piston is slidingly supported to form in combination with a cylinder head a combustion chamber; a fuel injector for the cylinder having a catalytic coated tip portion that projects into the combustion chamber; and an electronic controller to control the operation of the engine and operates the engine in a heating mode of operation if heating of the fuel injector tip is requested. Various methods for heating the fuel injector tip are proposed including operating the engine on a reduced number of cylinders and varying one or both of fuel injection timing and quantity of fuel injected and the ignition timing in order to increase the temperature of combustion It will be appreciated by those skilled in the art that although the invention has been described by way of example with reference to one or more embodiments it is not limited to the disclosed embodiments and that alternative embodiments could be constructed without departing from the scope of the invention as defined by the appended claims.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system comprising:

a direct injection engine having at least one cylinder in which a piston is slidingly supported to form in combination with a cylinder head at least one combustion chamber;

a fuel injector for the at least one cylinder having a fuel injector tip with a catalytic coated portion that projects into the combustion chamber; and an electronic controller with code to be programmed into non-transitory memory of a computer readable storage medium in the controller to control the operation of the engine and operate the engine in a heating mode of operation if heating of the fuel injector tip is requested, wherein the code to operate the engine in the heating mode further comprises code to disable each of the cylinders of the engine, one at a time in an order, so as to increase loading on each cylinder still operating and cool the disabled cylinder until the catalytic coating on the respective fuel injector tip of the operating cylinder is heated to a light-off temperature of the catalytic coating.

2. The engine system as claimed in claim 1 wherein if heating of the fuel injector tip is not requested, the electronic controller further includes code to operate the engine in a normal mode of operation.

3. The engine system as claimed in claim 1 wherein heating of the fuel injector tip is requested if a temperature of the catalytic coated portion is below light-off temperature of the catalytic coating.

4. The engine system as claimed in claim 3 wherein heating of the fuel injector tip is requested if the temperature of the catalytic coated portion is below the light-off temperature of the catalytic coating and de-coking of the fuel injector tip is requested.

5. The engine system as claimed in claim 1 wherein the code to operate the engine in the heating mode further comprises code to increase a temperature of combustion to adjust at least one of a timing of an injection of fuel and a quantity of fuel injected into the combustion chamber.

6. The engine system as claimed in claim 4 wherein the request to de-coke the fuel injector tip is based upon an accretion model.

7. The engine system as claimed in claim 1 wherein each disabled cylinder is arranged to pump air while it is disabled.

8. The engine as claimed in claim 1 wherein operating the engine in the heating mode comprises operating at least one cylinder rich of stoichiometric and at least one cylinder lean of stoichiometric so as to promote an increased combustion temperature and an oxidizing environment in the at least one lean operated cylinder.

9. The engine system as claimed in claim 1 wherein the engine is a spark ignited engine and code to operate the engine in the heating mode further includes code to increase a temperature of combustion of the operating cylinder by using the electronic controller to adjust a timing of an ignition to one of retarded and advanced relative to a normal timing position.

10. A method of operating a direct injection combustion engine, each cylinder of the engine having a fuel injector having a fuel injector tip with a catalytic coated portion that is exposed to products of combustion, comprising:

operating the engine in a heating mode of operation in response to a request to heat the fuel injector tip, the heating mode of operation including:

disabling each of the cylinders of the engine, one at a time in an order, so as to increase loading on cylinders still operating and cool the disabled cylinder, where the disabled cylinder remains disabled until the catalytic coating on the respective fuel injector tip of the operating cylinder is heated to a threshold.

11. The method as claimed in claim 10 wherein, if heating of the fuel injector tip is not requested, the method comprises operating the engine in a normal mode of operation.

12. The method as claimed in claim 10 wherein heating of the fuel injector tip is requested when a temperature of the catalytic coated portion is below a light-off temperature of a catalytic material and de-coking of the fuel injector tip is requested.

13. The method as claimed in claim 10 wherein operating the engine in the heating mode comprises adjusting at least one of a timing of an injection of fuel and a quantity of fuel injected into each operating cylinder.

14. The method as claimed in claim 12 wherein the request for de-coking of the fuel injector tip is based upon an accretion model.

15. The method as claimed in claim 10 wherein operating the engine in said heating mode comprises operating at least one cylinder rich of stoichiometric and at least one cylinder lean of stoichiometric so as to promote an increased combustion temperature and an oxidizing environment in the at least one lean operated cylinder.

16. The method as claimed in claim 10 wherein operating the engine in said heating mode comprises operating at least one cylinder lean of stoichiometric and at least one cylinder leaner than the at least one lean of stoichiometric operating cylinder so as to promote an increased combustion temperature in the at least one leaner operated cylinder.

17. The method as claimed in claim 10 wherein the engine is a spark ignited engine and operating the engine in the heating mode comprises adjusting a timing of an ignition to one of retarded and advanced relative to a normal timing position for each operating cylinder.

18. The method as claimed in claim 10 wherein disabling at least one of the cylinders of the engine comprises disabling fuel injection to the at least one disabled cylinder of the engine and where a predetermined number of cylinders are coupled through an exhaust manifold to a first catalytic converter and the remaining cylinders are coupled to another exhaust manifold to a second catalytic converter.

19. The method as claimed in claim 18 wherein said predetermined number of cylinders comprises one bank of a V-6 engine and said remaining cylinders comprise another bank of said V-6 engine.

20. The method as claimed in claim 18 wherein said predetermined number of cylinders comprises two outer cylinders of an I-4 engine and said remaining cylinders comprise two inner cylinders of said I-4 engine.

* * * * *